US007311052B2

(12) United States Patent
Kim

(10) Patent No.: US 7,311,052 B2
(45) Date of Patent: Dec. 25, 2007

(54) NEEDLE PLATE FOR DOUBLE-NEEDLE SEWING MACHINE

(75) Inventor: Hyun Sung Kim, Gyeonggi-do (KR)

(73) Assignee: Sunstar Machinery Co., Ltd. (KR)

( * ) Notice: Subject to any disclaimer, the term of this patent is extended or adjusted under 35 U.S.C. 154(b) by 0 days.

(21) Appl. No.: 11/553,183

(22) Filed: Oct. 26, 2006

(65) Prior Publication Data

US 2007/0095264 A1 May 3, 2007

(30) Foreign Application Priority Data

Oct. 27, 2005 (KR) ..... 10-2005-0101800

(51) Int. Cl.
*D05B 73/12* (2006.01)
*D05B 73/00* (2006.01)

(52) U.S. Cl. ..... 112/260

(58) Field of Classification Search ..... 112/260, 112/261, 227, 80.5, 80.16, 80.3, 163, 197; 269/289 R; 108/28
See application file for complete search history.

(56) References Cited

U.S. PATENT DOCUMENTS 2,975,736 A * 3/1961 Card ..... 112/80.5
2,983,028 A * 5/1961 Cole ..... 428/85
3,361,095 A * 1/1968 Short ..... 112/80.16
3,533,368 A * 10/1970 Finster ..... 112/227
4,791,875 A * 12/1988 Ackermann ..... 112/227
5,803,002 A * 9/1998 Faber et al. ..... 112/475.01
6,213,038 B1 * 4/2001 Sahl ..... 112/260

* cited by examiner

*Primary Examiner*—Ismael Izaguirre
(74) *Attorney, Agent, or Firm*—Grossman, Tucker, Perreault & Pfleger, PLLC

(57) ABSTRACT

Disclosed is a needle plate for a double-needle sewing machine. The needle plate includes a partition extending downward between the needle holes and provided with a thin plate insertion slit in an intermediate portion thereof, and a thin plate inserted into the thin plate insertion slit. Thus, the rigidity of a thin wall formed between the needle holes is reinforced by providing the partition and the thin plate inserted into the partition between the needle holes, so that stitches can be formed in parallel without breakage of the needle plate even when the interval between the needle holes is less than 2 mm.

2 Claims, 3 Drawing Sheets

NEEDLE PLATE FOR DOUBLE-NEEDLE SEWING MACHINE

BACKGROUND OF THE INVENTION

1. Field of the Invention

The present invention relates generally to a double-needle sewing machine, and more particularly, to a needle plate for a double-needle sewing machine that sews the edge of a thick workpiece with two lines of stitches.

2. Description of the Prior Art

FIGS. 1 and 2 are perspective views showing a needle plate for a conventional double-needle sewing machine.

A needle plate 10 used in a conventional double-needle post bed sewing machine has two needle holes 11*a* formed on the cross as shown in FIG. 1 or two needle holes 11*b* oppositely formed in parallel as shown in FIG. 2.

However, as shown in FIG. 2, on doing proximity sewing work of 2 mm or less using the later needle plate 10 in which the two needle holes 11*b* are opposite to each other, the interval between the two needle holes 11*b* is narrow, and thus the needle plate between the two needle holes 11*b* has been frequently broken due to interference between needles. Hence, it takes a great deal of expense and time to exchange the broken needle plate 10.

Meanwhile, as shown in FIG. 1, when the two needle holes 11*a* are formed on the cross, an interval between the two needle holes 11*a* is wide, and thus the needle plate between the two needle holes 11*a* is not broken. However, the sewn stitches are not formed in parallel as before.

SUMMARY OF TEE INVENTION

Accordingly, the present invention has been made to solve these various problems occurring in the prior art, and an objective of the present invention is to provide a needle plate for a double-needle sewing machine, in which a partition and a thin plate inserted into the partition are provided between needle holes so as to reinforce the rigidity of a thin wall formed between needle holes, so that stitches can be formed in parallel without the needle plate being damaged even when the interval between the needle holes is less than 2 mm.

In order to accomplish this objective, there is provided a needle plate for a double-needle sewing machine, in which a pair of needle holes is formed, through which needles sewing a workpiece pass. The needle plate includes a partition extending downward between the needle holes and provided with a thin plate insertion slit in an intermediate portion thereof, and a thin plate inserted into the thin plate insertion slit.

Here, the partition may be cut out and bisected on the basis of the needle holes.

Each cut face of the partition may be on a slant in order to avoid interference with the needles inserted through the needle holes.

The thin plate may be a heat-treated steel plate.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
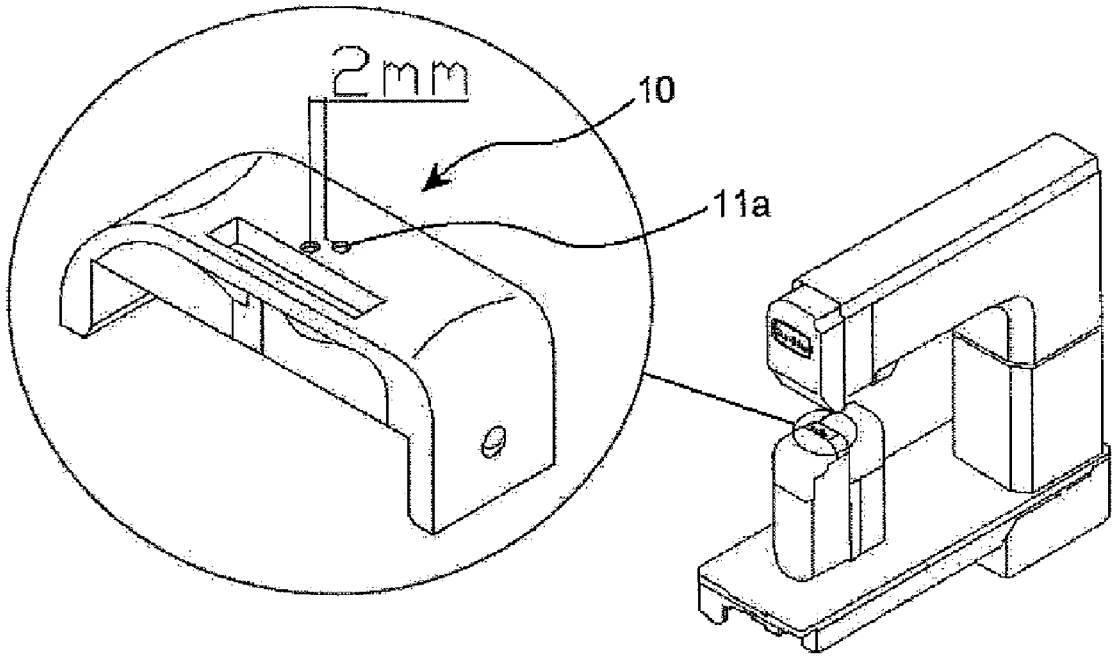
FIG.1 PRIOR ART
FIGS. 1 and 2 are perspective views showing a needle plate for a conventional double-needle sewing machine.
Figure 2:
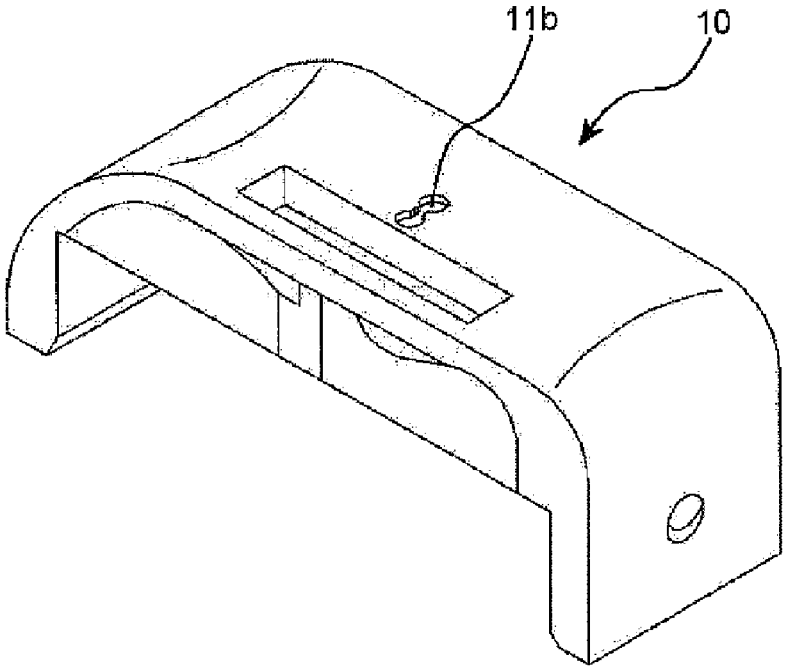
FIG.2 PRIOR ART

Hereinafter, exemplary embodiments of the present invention will be described with reference to the accompanying drawings. In the following description and drawings, the same reference numerals are used to designate the same or similar components, and so repetition of the description on the same or similar components will be omitted.

Figure 3:
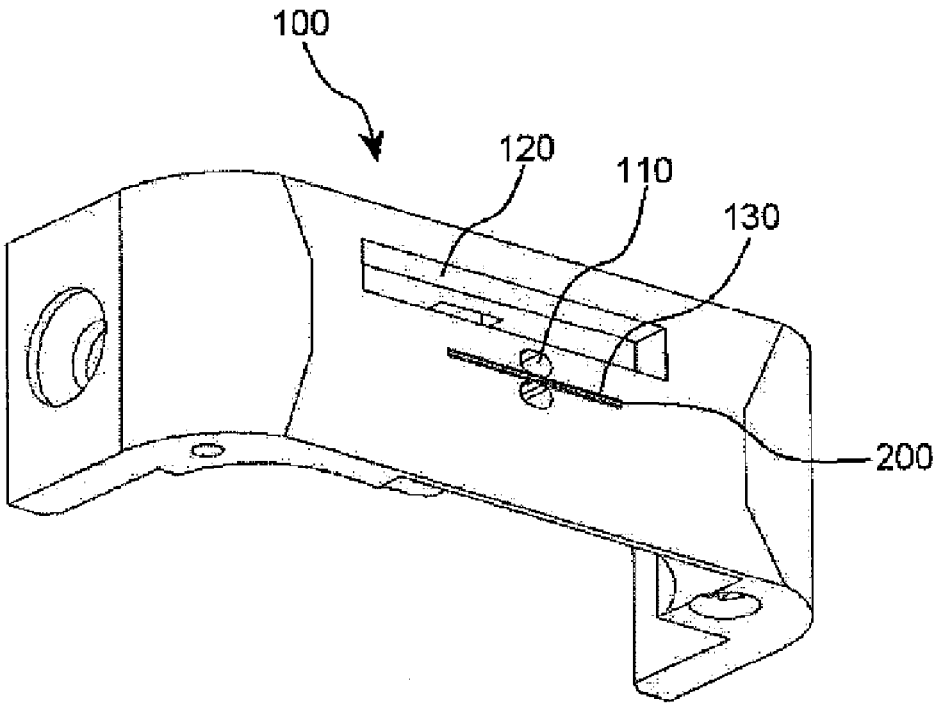
FIG. 3 is a top perspective view showing a state in which a thin plate is coupled to a needle plate for a double-needle sewing machine according to an embodiment of the present invention.
Figure 4:
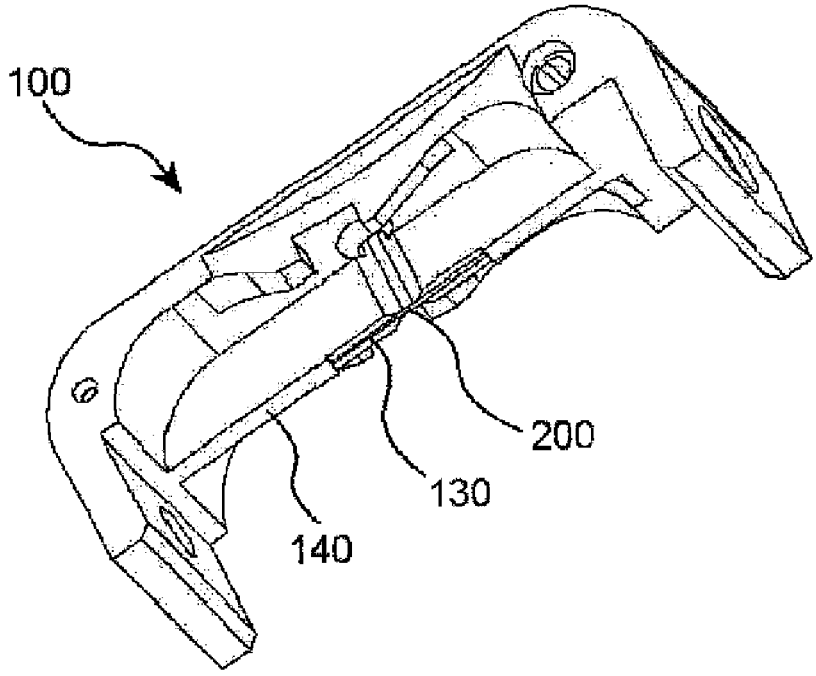
FIG. 4 is a bottom perspective view of FIG. 3.
Figure 5:
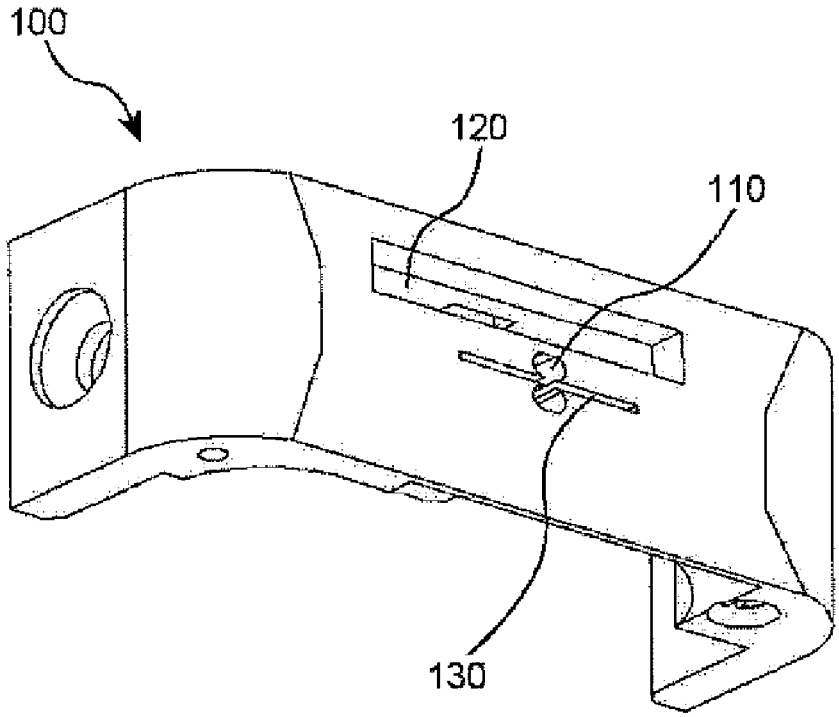
FIG. 5 is a top perspective view showing a state in which a thin plate is decoupled from a needle plate for a double-needle sewing machine according to an embodiment of the present invention.

FIG. 3 is a top perspective view showing a state in which a thin plate is coupled to a needle plate for a double-needle sewing machine according to an embodiment of the present invention, and FIG. 4 is a bottom perspective view of FIG. 3. FIG. 5 is a top perspective view showing a state in which a thin plate is decoupled from a needle plate for a double-needle sewing machine according to an embodiment of the present invention, and FIG. 6 is a bottom perspective view of FIG. 5.

Referring to FIGS. 3 through 6, the needle plate 100 for a double-needle sewing machine according to an embodiment of the present invention is formed with a transfer slot 120 on one side of a top surface thereof, wherein transfer teeth (not shown) for transferring a workpiece placed on a top surface of the needle plate 100 to one side protrude through the transfer slot 120. A pair of needle holes 110 is formed in the middle of the needle plate 100 in such a manner that their circumferential surfaces internally coming in contact with each other are opened. A thin plate insertion slit 130 is formed between the needle holes 110. The pair of needle holes 110 is separated into two holes by the thin plate inserted into the thin plate insertion slit 130.

A partition 140 extends on an inner side of the needle plate 100 in order to avoid interference with spaces in which two hooks (not shown) are situated, and the thin plate insertion slit 130 is formed at an intermediate portion of the partition 140 so as to be able to insert a thin plate 200.

Figure 6:
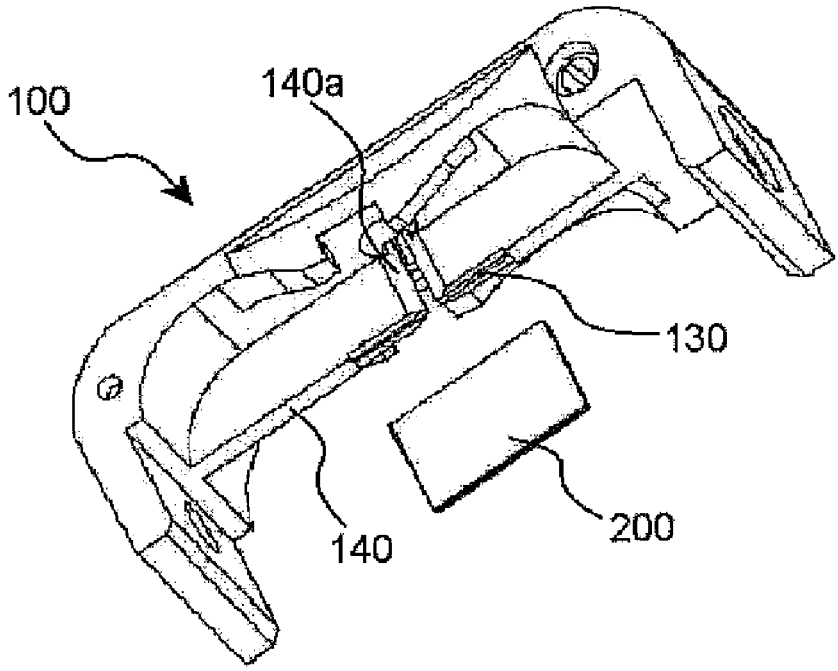
FIG. 6 is a bottom perspective view of FIG. 5.

Here, the intermediate portion of the partition 140 is preferably cut out and bisected on the basis of the needle holes 110 in order to avoid interference with needles, as shown in FIG. 6.

Further, each cut face 140*a* is preferably formed to have a V-shaped slant face in order to avoid the interference with the needles inserted through the needle holes 110.

Meanwhile, the thin plate 200 is a heat-treated steel plate (SK-5), and is preferably a metal that has a constant thickness and is not readily damaged by the interference with the needle. In this manner, the thin plate 200 having a high rigidity is inserted into the thin plate insertion slit 130 from the downside, thereby serving to discriminate the needle holes 110 from each other and simultaneously reinforce the needle plate between the needle holes 110, which have a high breakage possibility resulting from the interference between the needles, so that expense and time loss caused by the breakage are saved.

Meanwhile, the embodiment of the present invention has been described regarding the needle plate for a double-needle post bed sewing machine, but it may be applied to a needle plate for an ordinary flat bed sewing machine.

As can be seen from the foregoing, with the needle plate for the double-needle sewing machine according to the present invention, a partition and a thin plate inserted into the partition are provided between needle holes so as to reinforce the rigidity of a thin wall formed between needle holes, so that stitches can be formed in parallel without breakage of the needle plate even when the interval between the needle holes is less than 2 mm.

Furthermore, the needle plate as constructed in this manner has stronger durability against the interference of the needle when compared to the convention needle plate, so that a lifetime of the needle plate is prolonged, and expense and time loss caused by exchanging the needle plates when broken are saved.

Although exemplary embodiments of the present invention has been described for illustrative purposes, those skilled in the art will appreciate that various modifications, additions and substitutions are possible, without departing from the scope and spirit of the invention as disclosed in the accompanying claims.

What is claimed is:

1. A needle plate for a double-needle sewing machine, in which a pair of needle holes are formed, through which needles sewing a workpiece pass, the needle plate comprising:

a partition extending downward between the needle holes and provided with a thin plate insertion slit in an intermediate portion thereof; and a thin plate inserted into the thin plate insertion slit, wherein the partition is cut out and bisected on the basis of the needle holes and each cut face of the partition is on a slant in order to avoid interference with the needles inserted through the needle holes.

2. The needle plate as claimed in claim 1, wherein the thin plate is a heat-treated steel plate.

* * * * *